US009399304B2

(12) United States Patent
Tomassetti et al.

(10) Patent No.: US 9,399,304 B2
(45) Date of Patent: Jul. 26, 2016

(54) HEATED RAZOR WITH POWER SWITCH ON CARTRIDGE

(71) Applicants: L.P.I. Consumer Products, Inc., Pompano Beach, FL (US); Display Matrix Corporation, Randolph, NJ (US)

(72) Inventors: Louis D. Tomassetti, Pompano Beach, FL (US); William Bohmer, Randolph, NJ (US)

(73) Assignee: HEATED BLADES HOLDING COMPANY, LLC, Pompano Beach, FL (US)

( * ) Notice: Subject to any disclaimer, the term of this patent is extended or adjusted under 35 U.S.C. 154(b) by 220 days.

(21) Appl. No.: 14/306,802

(22) Filed: Jun. 17, 2014

(65) Prior Publication Data

US 2015/0360377 A1 Dec. 17, 2015

(51) Int. Cl.

*B26B 21/48* (2006.01)
*B26B 21/40* (2006.01)
*B26B 21/22* (2006.01)

(52) U.S. Cl.

CPC ..... *B26B 21/48* (2013.01); *B26B 21/222* (2013.01); *B26B 21/4012* (2013.01); *B26B 21/4056* (2013.01)

(58) Field of Classification Search

CPC ..... B26B 21/00; B26B 21/08; B26B 21/14; B26B 21/16; B26B 21/165; B26B 21/22; B26B 21/222; B26B 21/225; B26B 21/227; B26B 21/40; B26B 21/4012; B26B 21/405; B26B 21/4056; B26B 21/4062; B26B 21/48; B26B 21/526

USPC ..... 30/51, 57, 58, 34.05

See application file for complete search history.

(56) References Cited

U.S. PATENT DOCUMENTS

| | | | | |
|---|---|---|---|---|
| 6,817,101 | B1 | 11/2004 | Bohmer | |
| 6,836,966 | B2 | 1/2005 | Patrick | |
| 8,307,553 | B2 | 11/2012 | Follo et al. | |
| 8,533,958 | B2 | 9/2013 | Tomassetti et al. | |
| 8,713,801 | B2 | 5/2014 | Bohmer et al. | |
| 2006/0123631 | A1 * | 6/2006 | Szczepanowski | B26B 21/225 30/44 |
| 2011/0167640 | A1 * | 7/2011 | Flyash | B26B 21/48 30/34.05 |
| 2012/0222310 | A1 | 9/2012 | Tomassetti et al. | |

* cited by examiner

*Primary Examiner* — Phong Nguyen

(74) *Attorney, Agent, or Firm* — Robert M. Downey, P.A.

(57) ABSTRACT

A blade heating system for a heated razor includes electrically conductive blades contained in a blade cartridge. A switch lever is hingedly attached to the blade cartridge and is selectively positionable between a closed position, wherein the switch lever is closed against the back of the blade cartridge, and an open position, wherein the switch lever is opened away from the back of the blade cartridge. Electrically conductive leads are connected to positive and negative terminal ends of a battery carried on the switch lever. One or more electrically conductive blade contacts are provided for electrically connecting the one or more blades to the conductive leads and battery when the switch lever is in the closed position for delivering electric current to the one or more electrically conductive blades. In a preferred embodiment, magnets are used to releasably hold the switch lever closed against the back of the blade cartridge.

20 Claims, 4 Drawing Sheets

HEATED RAZOR WITH POWER SWITCH ON CARTRIDGE

BACKGROUND OF THE INVENTION

1. Field of the Invention

The present invention relates generally to razors for shaving and, more particularly, to a battery powered system in a razor for heating the blades of the razor.

2. Discussion of the Related Art

It is known that the cutting edge of a razor blade cuts hair more effectively when it is warm or hot. It is also common practice to place the razor blades under hot running water in order to heat the blades just prior to stroking the blades over the skin in order to cut the hairs. However, the heat cutting performance of the blades lasts only a short time during the beginning of the shaving stroke. Within seconds, the temperature of the blades is quickly reduced due to contact with the user's wet skin and exposure to the ambient air. Ideally, it is best to maintain the heated temperature of the blades constant throughout the shaving process to achieve better performance and increased shaving comfort.

The present invention serves to provide a blade heating system for a heated razor wherein the blades of the razor may be selectively heated by closing a switch lever that is hingedly attached to the blade cartridge.

SUMMARY OF THE INVENTION

The present invention is directed to a blade heating system for a heated razor including one or more electrically conductive blades that are contained in a blade cartridge so that the cutting edge of each of the one or more blades is operatively positioned for cutting hairs when the blade cartridge is moved along the skin surface of a user. A switch lever is hingedly attached to the blade cartridge and is selectively positionable between a closed position, wherein the switch lever is closed against the blade cartridge, and an open position, wherein the switch lever is opened away from the blade cartridge. First and second electrically conductive leads are connected to the positive and negative terminal ends of the battery. One or more electrically conductive blade contacts are provided for electrically connecting the one or more electrically conductive blades to the battery when the switch lever is in the closed position for delivering electric current to the one or more electrically conductive blades. In a preferred embodiment, the conductive contacts are made from a material having a high electrical resistance, such as Nichrome. In one embodiment, the conductive contacts are secured to the back non-cutting edges of each of the one or more blades. The blades are heated by closing the switch lever, which causes the conductive leads to electrically connect with the one or more conductive contacts and send electric current through the one or more blades. In another embodiment, the conductive contacts are each secured to a respective one of the conductive leads on the switch lever. The blades are heated by closing the switch lever, which causes the conductive contacts to mate against the back non-cutting edges of the one or more blades, in electrical connection therewith, and send electric current through the blades. In a preferred embodiment, magnets are used to hold the switch lever in the closed position against the back and top of the blade cartridge. In one embodiment, the conductive contacts are magnetized for releasably connecting with the back non-cutting edge of the blades when the switch lever is in the closed position. In one embodiment, the power source comprises one or more batteries housed on or in the switch lever or blade cartridge. In another embodiment, the power source comprises one or more batteries housed in the handle of the razor.

OBJECTS AND ADVANTAGES OF THE INVENTION

Considering the foregoing, it is a primary object of the present invention to provide a blade heating system for a razor having one or more blades that are heated by sending an electric current through the blades.

It is a further object of the present invention to provide a blade heating system for a razor wherein heating of the one or more blades is actuated by closing a switch lever that is hingeldy attached to the blade cartridge containing the blades.

It is still a further object of the present invention to provide a blade heating system for a razor that provides for increased efficiency of battery power consumption.

These and other objects and advantages of the present invention are more readily apparent with reference to the following detailed description and the accompanying drawings.

BRIEF DESCRIPTION OF THE DRAWINGS

For a fuller understanding of the nature of the present invention, reference should be made to the following detailed description taken in conjunction with the accompanying drawings in which.

Like reference numerals refer to like parts throughout the several views of the drawings.

DETAILED DESCRIPTION OF THE PREFERRED EMBODIMENTS

Figures 1, 2:
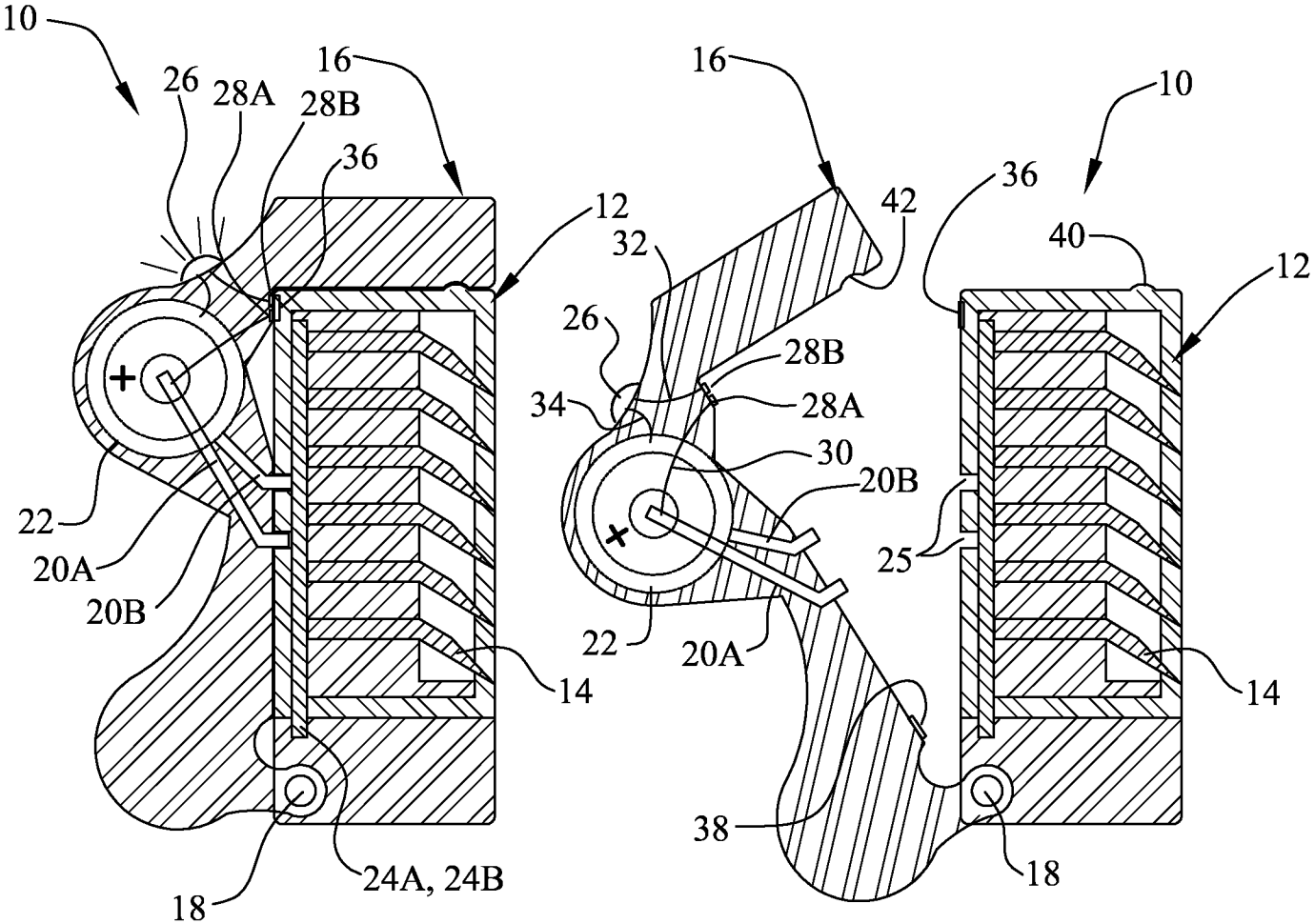
FIG. 1 is a side elevational view, shown in cross-section, of one embodiment of the blade heating system for a razor of the present invention, and illustrating a blade cartridge and switch lever in the closed position.
FIG. 2 is a side elevational view, shown in cross-section, of one embodiment of the blade heating system for a razor of the present invention, and illustrating a blade cartridge and switch lever in the opened position.

Referring to the several views of the drawings, the blade heating system of the present invention is shown and is generally indicated as 10.

Referring to FIGS. 1-4, a first embodiment of the blade heating system 10 for a heated razor includes a blade cartridge 12 containing one or more electrically conductive blades 14 that are contained within the cartridge 12 such that the cutting edge of each of the one or more blades 14 is operatively positioned for cutting hairs when the blade cartridge 12 is moved along the skin surface of a user. A switch lever 16 is hingedly attached to the blade cartridge 12 by pin 18 and is selectively positionable between a closed position, wherein the switch lever 16 is closed against the blade cartridge 12, and an open position, wherein the switch lever 16 is opened away from the blade cartridge 12. First and second electrically conductive leads 20A and 20B are connected to the positive and negative terminal ends of the battery 22 that is housed on or within the switch lever 16. A pair of electrically conductive blade contacts 24A and 24B are provided for electrically connecting the one or more electrically conductive blades 14 to the battery 22 when the switch lever 16 is in the closed position for delivering electric current to the one or more electrically conductive blades 14. In one embodiment, the conductive contacts 24A and 24B are made from a material having a high electrical resistance, such as Nichrome.

Referring to FIGS. 1 and 2, in one embodiment of the blade heating system 10, the conductive contacts 24A and 24B are secured to the back non-cutting edges of each of the one or more blades 14. The blades 14 are heated by closing the switch lever 16 against the blade cartridge 12, which causes the conductive leads 20A and 20B to contact and electrically connect with the conductive contacts 24A and 24B, respectively, through openings 25 to thereby send electric current through the electric circuit for heating the one or more blades 14. The blade heating system 10 is turned off by hingedly moving the switch lever 16 back and thereby separating the switch lever 16 from the back and top of the blade cartridge 12. In this open position, the conductive leads 20A and 20B are separated from the conductive blade contacts 24A and 24B, thereby opening the electric circuit.

Still referring to FIGS. 1 and 2, an indicator light 26, such as an LED light, on the switch lever 16 is provided for indicating whether the battery 22 is in electrical connection with the blades 14 (i.e., whether the blades 14 are heated). First and second electrically conductive contacts 28A and 28B on switch lever 16 are electrically connected to the battery 22. Conductive contact 28A is connected to the positive terminal end of the battery 22 by electrically conductive wire 30. Conductive contact 28B is connected to the light 26 by electrically conductive wire 32. Electrically conductive wire 34 connects the light 26 with the negative terminal end of battery 22. When the switch lever 16 is in the closed position against the blade cartridge 12, the first and second electrically conductive contacts 28A and 28B are in contact with an electrically conductive contact plate 36 on the blade cartridge 12, which completes the circuit between the light 26 and battery 22 and thereby causes the light 26 to illuminate. In addition to an indicator light 26, other electrically powered devices, such as a temperature gauge and sensor, may be powered in the manner described above.

Figure 4:
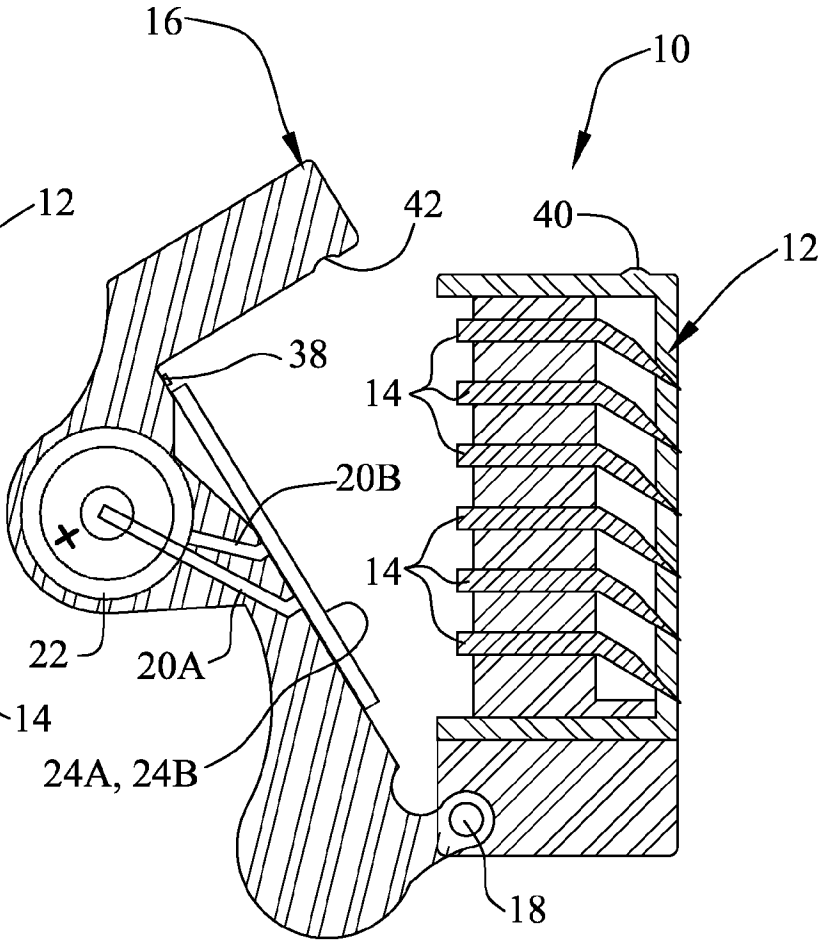
FIG. 4 is a side elevational view, shown in cross-section, of one embodiment of the blade heating system for a razor of the present invention, and illustrating a blade cartridge and switch lever in the open position.
Figure 3:
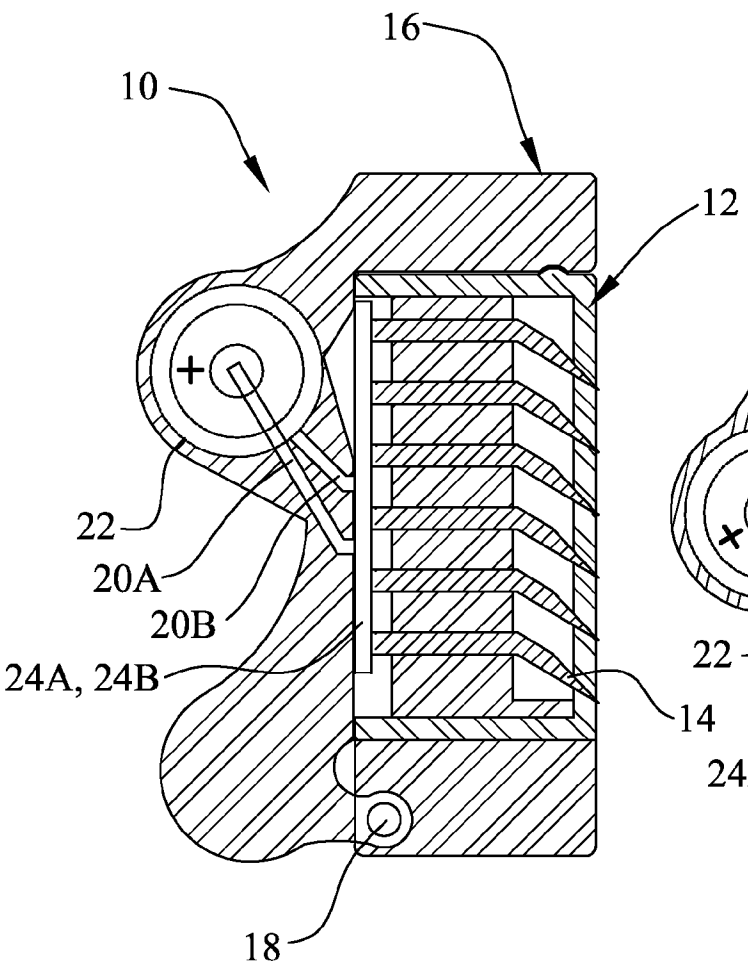
FIG. 3 is a side elevational view, shown in cross-section, of one embodiment of the blade heating system for a razor of the present invention, and illustrating a blade cartridge and switch lever in the closed position.

Referring to FIGS. 3 and 4, another embodiment of the blade heating system 10 is shown, wherein the conductive contacts 24A and 24B are each affixed to conductive leads 20A and 20B, respectively, on the switch lever 16. The blades 14 are heated by closing the switch lever 16 against the blade cartridge 12, which causes the conductive contacts 24A and 24B to mate against the back non-cutting edges of the one or more blades 14, in electrical connection therewith, and send electric current through the electric circuit for heating the blades 14. The blade heating system 10 is turned off by hingedly moving the switch lever 16 from the back and top of the blade cartridge 12, thereby separating the conductive conducts 24A and 24B from the back non-cutting edges of the blades 14 and opening the electric circuit.

One or more magnets 38 may be used to magnetically attract the switch lever 16 against the back of the blade cartridge 12 for maintaining a firm connection between the conductive contacts 24A, 24B and the back edges of the blades 14 when the switch lever 16 is in the closed position. In one embodiment, the conductive contacts 24A and 24B are magnetized for releasably connecting the conductive contacts with the back non-cutting edge of the blades 14 when the switch lever 16 is in the closed position. In another embodiment, as shown in FIGS. 2 and 4, a magnet 38 may be located on the switch lever 16 for magnetically attracting the switch lever 16 to the blade cartridge 12 in the closed position.

In addition to (or lieu of) the magnets 38, a snap-fit mechanism including protruding member 40 and recess 42 may be used for maintaining a firm connection between the switch lever 16 and blade cartridge 12. The protruding member 40 is sized to engage the recess 42 when the switch lever 16 is in the closed position for holding the switch lever 16 against the blade cartridge 12.

Figure 5:
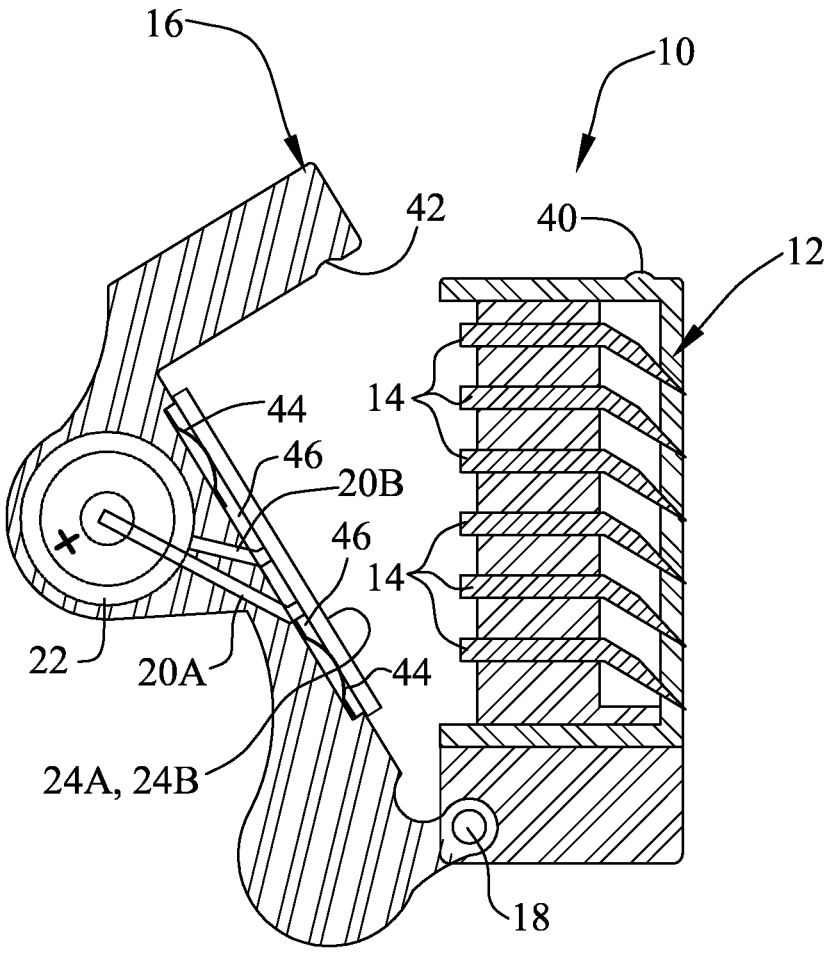
FIG. 5 is a side elevational view, shown in cross-section, of a further embodiment of the invention, wherein spring elements are provided to urge the conductive contracts into engagement with the back non-cutting edges of the blades.

Referring to FIG. 5, a further embodiment of the invention provides one or more spring elements 44 for urging the conductive contacts 24A, 24B against the back non-cutting edges of the blades 14 when the switch lever 16 is in the closed position. Specifically, spring elements 44, such as leaf springs, are fitted within a recessed channel 46 formed in the switch lever 16. The leaf springs apply constant pressure on the back side of the conductive contacts 24A and 24B so that when the switch lever 16 is in the closed position, the conductive contacts 24A and 24B are urged against the back non-cutting edges of the blades 14.

Figure 6:
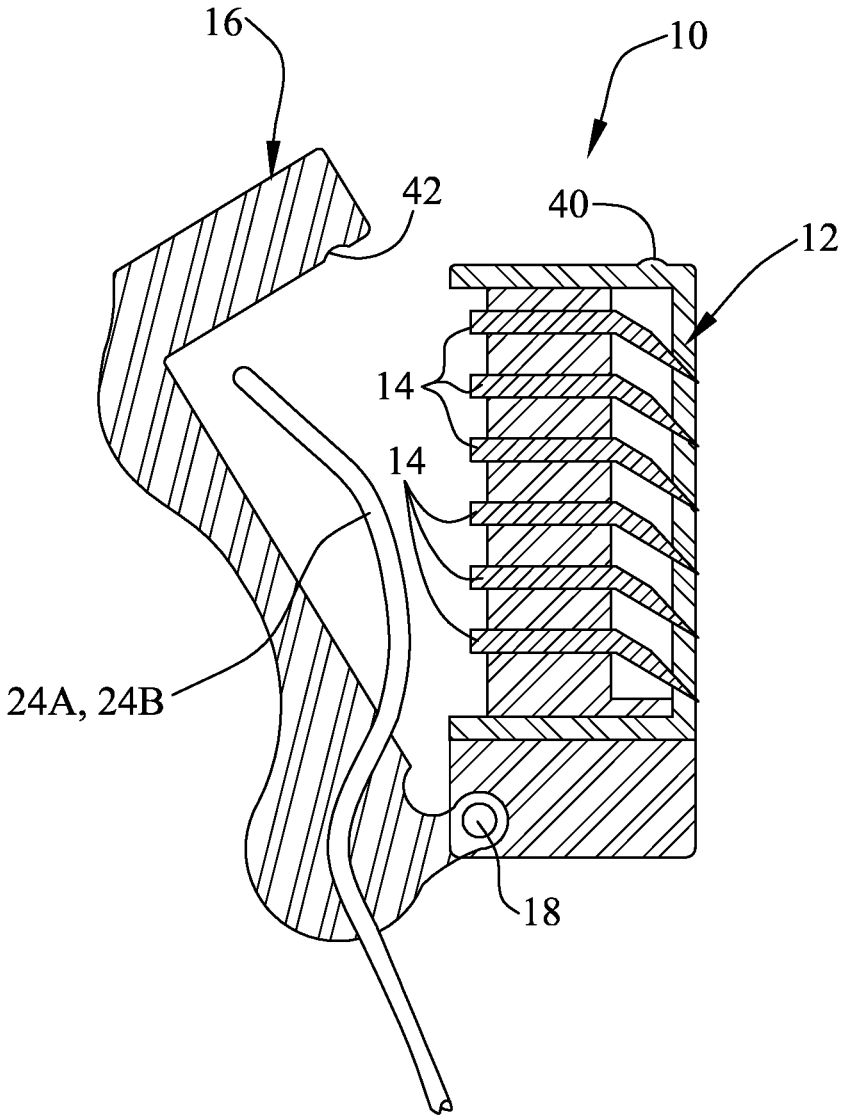
FIG. 6 is a side elevational view, shown in cross-section, of yet a further embodiment of the invention, wherein the conductive contacts are in the form of arched wires that extend through the switch lever for connection to a power source (e.g., one or more batteries) located in a handle of the razor.

Referring to FIG. 6, a further embodiment of the invention eliminates the battery power source on the blade cartridge 12. In this particular embodiment, the conductive contacts 24A and 24B are in the form of arched wires that extend through the switch lever 16 for connection to a power source (e.g., one or more batteries) located in the handle of the razor. When the switch lever 16 is in the closed position against the blade cartridge 12, the conductive contacts 24A and 24B are in contact with the one or more electrically conductive blades 14 for delivering electric current thereto. The arched conductive contacts 24A and 24B are structured to bend when pressed against the one or more blades 14 as the switch lever 16 is moved into the closed position against the blade cartridge 12. The spring force exerted by the arched conductive contacts 24A and 24B maintains a secured electrical connection between the contacts 24A and 24B and the blades 14 when the switch lever 16 is in the closed position.

While the present invention has been shown and described in accordance with several preferred and practical embodiments, it is recognized that departures from the instant disclosure are contemplated within the spirit and scope of the present invention which are not to be limited except as defined in the following claims as interpreted under the Doctrine of Equivalents.

What is claimed is:

1. A blade heating system for a razor, and said blade heating system comprising:

a plurality of electrically conductive blades each having a cutting edge and a back non-cutting edge;

a blade cartridge structured and configured for containing said plurality of electrically conductive blades within said cartridge so that the cutting edge of each of said plurality of blades is operatively positioned for cutting hairs when the blade cartridge is moved along the skin surface of a user, and said blade cartridge having a top surface and a back;

a switch lever hingedly attached to said blade cartridge, and said switch lever being selectively positionable between a closed position against said blade cartridge and an open position defined by said switch lever being moved away from said blade cartridge;

a battery carried on said switch lever and including a positive and a negative terminal; and at least one conductive contact for electrically connecting said plurality of electrically conductive blades to the battery when said switch lever is in the closed position for delivering electric current to said plurality of electrically conductive blades, wherein flow of the electric current through said plurality of blades causes said plurality of blades to be heated.

2. The blade heating system for a razor as recited in claim 1 further comprising first and second conductive leads each being in connection with one of the negative and positive terminals of the battery, and said conductive leads being structured and disposed for delivering electric current between the battery and said at least one conductive contact when said switch lever is in the closed position.

3. The blade heating system for a razor as recited in claim 1 further comprising a protruding member on one of said blade cartridge or switch lever and a corresponding recess opening on the other of said blade cartridge or said switch lever, and wherein said protruding member is sized and configured to snap into said recess opening when said switch lever is in the closed position.

4. The blade heating system for a razor as recited in claim 1 further comprising a magnet on said switch lever, and said magnet being structured and disposed for magnetically attracting said switch lever against the blade cartridge for releasably connecting said switch lever to said blade cartridge when said switch lever is in the closed position.

5. The blade heating system for a razor as recited in claim 1 wherein said at least one conductive contact is made from Nichrome.

6. A blade heating system for a razor, and said blade heating system comprising:

a plurality of electrically conductive blades each having a cutting edge and a back non-cutting edge;

a blade cartridge structured and configured for containing said plurality of electrically conductive blades within said cartridge so that the cutting edge of each of said plurality of blades is operatively positioned for cutting hairs when the blade cartridge is moved along the skin surface of a user, and said blade cartridge having a top surface and a back;

a switch lever hingedly attached to said blade cartridge, and said switch lever being selectively positionable between a closed position against the back of said blade cartridge and an open position defined by said switch lever being moved away from the back of said blade cartridge;

a battery carried on said switch lever and having a positive terminal and a negative terminal;

first and second conductive leads each being in connection with one of the negative and positive terminals of the battery;

at least one conductive contact connected to the back non-cutting edge of each of said plurality of blades; and wherein positioning said switch lever in the closed position causes said first and second conductive leads to mate against with said at least one conductive contact, in electrical connection therewith, thereby electrically connecting said plurality of electrically conductive blades to the negative and positive terminals of the battery, wherein flow of the electric current through said plurality of blades causes said plurality of blades to be heated.

7. The blade heating system for a razor as recited in claim 6 further comprising a protruding member on said blade cartridge and a recess opening on said switch lever, and wherein said protruding member is sized and configured to snap into said recess opening when said snap lever is in the closed position.

8. The blade heating system for a razor as recited in claim 6 further comprising a magnet on said switch lever, and said magnet being structured and disposed for magnetically attracting said switch lever to the blade cartridge for releasably connecting said switch lever to said blade cartridge when said switch lever is in the closed position.

9. The blade heating system for a razor as recited in claim 6 wherein said at least one conductive contact is magnetized for magnetically attracting said at least one conductive contact to at least one of the back non-cutting edges of the plurality of blades for releasably connecting said switch lever to said blade cartridge when said switch lever is in the closed position.

10. The blade heating system for a razor as recited in claim 6 wherein said at least one conductive contact is made from Nichrome.

11. A blade heating system for a razor, and said blade heating system comprising:

a plurality of electrically conductive blades each having a cutting edge and a back non-cutting edge;

a blade cartridge structured and configured for containing said plurality of electrically conductive blades within said cartridge so that the cutting edge of each of said plurality of blades is operatively positioned for cutting hairs when the blade cartridge is moved along the skin surface of a user and said blade cartridge having a top surface and a back;

a switch lever hingedly attached to said blade cartridge, and said switch lever being selectively positionable between a closed position against the top surface and back of said blade cartridge and an open position defined by said switch lever being moved away from the top surface and back of said blade cartridge;

at least one battery carried on said switch lever and having a positive terminal and a negative terminal;

first and second conductive leads each being in connection with one of the negative and positive terminals of the battery;

first and second conductive contacts each being connected with one of said first and second conductive leads; and wherein positioning said switch lever in the closed position causes said first and second conductive contacts to mate against the back non-cutting edge of each of said plurality of blades, thereby electrically connecting said plurality of electrically conductive blades to the negative and positive terminals of the battery, wherein flow of the electric current through said plurality of blades causes said plurality of blades to be heated.

12. The blade heating system for a razor as recited in claim 11 further comprising a protruding member on said blade cartridge and a recess opening on said switch lever, and wherein said protruding member is sized and configured to snap into said recess opening when said snap lever is in the closed position.

13. The blade heating system for a razor as recited in claim 11 further comprising a magnet on said switch lever, and said magnet being structured and disposed for magnetically attracting said switch lever to the blade cartridge for releasably connecting said switch lever to said blade cartridge when said switch lever is in the closed position.

14. The blade heating system for a razor as recited in claim 11 wherein said first and second conductive contacts are magnetized for magnetically attracting said conductive contacts to at least one of the back non-cutting edges of the plurality of blades for releasably connecting said switch lever to said blade cartridge when said switch lever is in the closed position.

15. The blade heating system for a razor as recited in claim 11 wherein said first and second conductive contacts are made from Nichrome.

16. A blade heating system for a razor, and said blade heating system comprising:

a plurality of electrically conductive blades each having a cutting edge and a back non-cutting edge;

a blade cartridge structured and configured for containing said plurality of electrically conductive blades within said cartridge so that the cutting edge of each of said plurality of blades is operatively positioned for cutting hairs when the blade cartridge is moved along the skin surface of a user, and said blade cartridge having a top surface and a back;

a switch lever hingedly attached to said blade cartridge, and said switch lever being selectively positionable between a closed position against said blade cartridge and an open defined by said switch lever being moved away from said blade cartridge; and at least one conductive contact for electrically connecting said plurality of electrically conductive blades to a power source when said switch lever is in the closed position for delivering electric current to said plurality of electrically conductive blades, wherein flow of the electric current through said plurality of blades causes said plurality of blades to be heated.

17. The blade heating system for a razor as recited in claim 16 wherein the power source comprises at least one battery in a handle of the razor.

18. The blade heating system for a razor as recited in claim 16 wherein said at least one conductive contact is an arched wire that is structured and disposed to exert a spring force against the back non-cutting edge of each of said plurality of electrically conductive blades when said switch lever is in the closed position.

19. The blade heating system for a razor as recited in claim 16 further comprising:

an electrically powered indicator device;

first and second electrically conductive contacts on said switch lever, and said first and second electrically conductive contacts being in electrical connection with the power source; and an electrically conductive contact plate on said blade cartridge for electrically connecting said electrically powered device to the power source when said switch lever is in the closed position for delivering electric current to said electrically powered device and thereby powering said electrically powered device.

20. The blade heating system for a razor as recited in claim 19 wherein said electronically powered indicator device is an indicator light.

* * * * *